US008162030B2

(12) United States Patent
Schulze et al.

(10) Patent No.: US 8,162,030 B2
(45) Date of Patent: Apr. 24, 2012

(54) MOLD FOR CASTING METAL

(75) Inventors: Stephan Schulze, Meerbusch (DE); Dirk Lieftucht, Ledgen (DE); Uwe Plociennik, Ratingen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/001,447

(22) PCT Filed: Jun. 23, 2009

(86) PCT No.: PCT/EP2009/004504

§ 371 (c)(1),
(2), (4) Date: Apr. 22, 2011

(87) PCT Pub. No.: WO2009/156115

PCT Pub. Date: Dec. 30, 2009

(65) Prior Publication Data

US 2011/0186262 A1 Aug. 4, 2011

(30) Foreign Application Priority Data

Jun. 25, 2008 (DE) ..... 10 2008 029 742

(51) Int. Cl.
*B22C 19/00* (2006.01)
*B22D 11/16* (2006.01)

(52) U.S. Cl. ..... 164/151.4; 164/450.3

(58) Field of Classification Search ..... 164/4.1–458, 164/150.1–157; 374/130, 179, 139, 4, 5, 374/137, 29, 30, 112, 110; 266/274; 73/295
See application file for complete search history.

(56) References Cited

U.S. PATENT DOCUMENTS

| | | | |
|---|---|---|---|
| 4,075,890 | A | 2/1978 | Iwasaki et al. |
| 6,776,217 | B1 | 8/2004 | Streubel et al. |
| 7,043,404 | B2 | 5/2006 | Arzberger et al. |

FOREIGN PATENT DOCUMENTS

| | | |
|---|---|---|
| DE | 2655640 | 10/1977 |
| DE | 3436331 | 4/1986 |
| DE | 4125146 | 2/1993 |
| DE | 10028304 A | 12/2001 |
| EP | 0057627 X | 8/1982 |
| EP | 0101521 | 2/1984 |
| EP | 1060046 | 7/2002 |
| EP | 0943382 | 8/2004 |
| EP | 1103322 | 3/2005 |
| EP | 1247080 | 2/2007 |

(Continued)

*Primary Examiner* — Jessica L Ward
*Assistant Examiner* — Steven Ha
(74) *Attorney, Agent, or Firm* — Lucas & Mercanti, LLP; Klaus P. Stoffel

(57) ABSTRACT

The invention relates to a mould for casting metal, having a plurality of temperature measuring devices (300) that are arranged in a wall (100) of the mould in order to detect the temperature distribution at that location. In order to make it easier to install the plurality of temperature measuring devices in the wall and in order to increase the reliability of the measurement results from said devices, it is proposed according to the invention to arrange the temperature measuring devices (300) such that they are positioned fixedly with respect to one another in a module (400), such that the temperature measuring devices together with the module form a structural unit which can be preassembled before the mould is installed. The structural unit is then fastened in or to the wall of the mould as the mould is being assembled.

15 Claims, 6 Drawing Sheets

FOREIGN PATENT DOCUMENTS

| | | |
|---|---|---|
| EP | 1289692 | 3/2007 |
| JP | 58145344 | 8/1983 |
| JP | 58148063 | 9/1983 |
| JP | 60099467 | 6/1985 |
| JP | 61219456 | 9/1986 |
| JP | 2151356 | 6/1990 |
| JP | 6074837 | 3/1994 |
| JP | 6304727 | 11/1994 |
| JP | 6320245 | 11/1994 |
| JP | 11104787 | 4/1999 |
| JP | 2002011558 | 1/2002 |
| JP | 2005125402 | 5/2005 |
| WO | 2004015349 | 2/2004 |
| WO | 2004082869 | 9/2004 |
| WO | WO 2004082869 A1 * | 9/2004 |
| WO | 2005106209 | 11/2005 |
| WO | 2006000334 | 1/2006 |
| WO | 2008089208 | 7/2008 |

* cited by examiner

MOLD FOR CASTING METAL

The present application is a 371 of International application PCT/EP2009/004504 filed Jun. 23, 2009, which claims priority of DE 10 2008 029 742.9, filed Jun. 25, 2008, the priority of these applications is hereby claimed and these applications are incorporated herein by reference.

BACKGROUND OF THE INVENTION

The invention concerns a mold for casting metal with a plurality of temperature measuring devices that are arranged in a wall of the mold for determining the temperature distribution in the wall during the casting operation.

Molds of this type with a plurality of temperature measuring devices are known from the prior art. An example of a mold of this type is disclosed in International Patent Application WO 2004/082869 A1. According to the technical disclosure of the cited document, the temperature measuring devices in the form of thermocouples are mounted in individual bores provided specifically for them. The individual thermocouples are pressed against the bottom of the bore by spring tension to ensure contact of their measuring points with the mold material. The thermocouples are mounted at different depths in the mold plate. This is especially useful for determining the heat flow density in the mold plate.

The aforementioned type of individual mounting of each individual thermocouple in the mold plate requires a large amount of installation work. The thermocouples are typically connected by a separate Harting connector. The connector is often inadvertently damaged during installation, which then requires an expensive reconstruction of the correct manner of connection. The correct positioning of the thermocouples relative to one another presents problems. At a distance of, for example, only 10 mm, a deviation of the bore depth and thus of the position of the measuring tips of the thermocouples in the depth direction of only 1 mm leads to a deviation of ten percent in the measurement result.

Proceeding from this prior art, the objective of the invention is to further develop a known metal-casting mold with a plurality of temperature measuring devices in such a way that the effort involved in the installation of the plurality of temperature measuring devices is reduced, but at the same time a high degree of reliability and validity of the measurement results are preserved.

SUMMARY OF THE INVENTION

This objective is achieved by the object of claim 1, which is characterized in that the temperature measuring devices are arranged in a module with fixed positioning relative to one another, that the temperature measuring devices, together with the module, form a structural unit, and that the structural unit is mounted in or on the wall of the mold to determine the temperature distribution.

The great advantage of the solution according to the invention is that the structural unit, i.e., the module with the temperature measuring devices arranged therein, can be preassembled in the manufacturer's workshop before the assembly of the whole mold in a casting installation.

The preassembly of the temperature measuring devices in the module has the advantage that it allows free and exact positioning of the temperature measuring devices relative to one another, i.e., at a desired correct distance from one another and at the correct depth; in particular, the distances are no longer defined of necessity by the distances separating the mounting bolts with which the water tank is screwed onto the mold and in which the temperature measuring devices, especially in the form of thermocouples, have traditionally been held. Instead, preassembly in the module allows such short distances between the temperature measuring devices or between their measuring tips, e.g., 10 mm, that continuous monitoring of the cooling and solidifying strand in the mold with respect to the formation of longitudinal cracks and the early detection of breakout over the entire width of the strand is possible by evaluation of the measured temperature distribution. In general, the free positioning of the temperature measuring devices makes it possible to reduce the deviations of the measurement results to a minimum and thus greatly increase the validity of the measurement.

During the final assembly of the mold, it then only remains to mount the structural unit as a whole, including the temperature measuring devices, in or on the wall. Therefore, the work of installing the temperature measuring devices during the final assembly of the mold is reduced to a minimum.

In accordance with a first embodiment of the invention, the wall of the mold has a recess for mounting the structural unit. In this regard, care must be taken to ensure optimum heat transfer between the structural unit and the material of the mold. To this end, it is important, for one thing, that the depth of the recess be adjusted to the depth or height of the module, and, in particular, that the best possible large-area contact be created between the bottom or the wall of the recess in the mold and the surface of the module or the tips of the temperature measuring devices in order to guarantee optimum heat transfer between the module and the wall of the mold. The heat transfer can be improved, for example, by the use of a heat-conducting plate, which, of course, must be able to withstand the high temperatures that arise during the casting operation in the mold.

The structural unit is embedded in a wall of the mold, e.g., from the cold side, or mounted on it. So that the structural unit does not impair the flow of coolant in the cooling channels of the mold wall, the structural unit in this case is mounted between two adjacent cooling channels.

Alternatively, the recess for the structural unit is formed as a lateral, preferably horizontal, bore in the wall of the mold between its hot side and the bottom of the cooling channels.

To cause the least possible disturbance of the heat flow in the wall of the mold, after the structural unit has been mounted, the recess is sealed again by a plate-like covering, preferably flush with the outer surface of the wall of the mold. Heat flow through the cover is then also possible.

The module or the structural unit and the recess in or on the cold side of the mold preferably have a stepped construction in the direction of the thickness of the mold, i.e., in the direction transverse to the casting direction or from the cold side to the hot side. The stepped construction has the advantage that it stabilizes the module or the structural unit in the mold against tilting.

Not only the cold side of the mold has a recess, as described above, but also the module has its own recess, hereinafter referred to as a temperature measuring device recess, for holding one temperature measuring device each. In this regard, the temperature measuring device is arranged in the temperature measuring device recess in such a way that its measuring tip or tips are in contact with the bottom or the wall of the recess.

The temperature measuring device can be designed, for example, as a thermocouple or as a fiber optic temperature sensor. The latter allows a temperature measurement by the optical time domain reflectometry (OTDR) method or the fiber Bragg grating (FBG) method. The fiber optic temperature sensors are very thin; this has the advantage that many temperature measuring sites can be arranged close to one another without their signals or measurement results mutually affecting or distorting one another.

For the purpose of reliable measurement of the heat flow density, the temperature measuring devices are arranged in pairs in the module, such that the two temperature measuring devices of a pair, especially thermocouples, preferably extend different depths into the module or into the mold.

Accordingly, the temperature measuring device recesses in the module are formed with different depths.

The recesses for the temperature measuring devices in the module can be formed, for example, as bores (stepped or not stepped) or as grooves at the edge of the module. Formation of the recess as a groove has the advantage that, in particular, the tip of the temperature measuring device is also accessible upon insertion into the module or the groove, and contact between the tip of the measuring device and the bottom or the base of the temperature measuring device recess can be ensured. When thermocouples are used, it is advantageous for their measuring tips to be soldered with the bottom of the grooves to guarantee optimum contact and heat transfer as well as exact positioning.

The temperature measuring devices are fixed in the temperature measuring device recesses in the module. The temperature measuring devices can be fixed in the corresponding recesses by gluing or clamping them in. To glue them in, it is advantageous to use highly heat-resistant resin, e.g., strain gage resin. Alternatively, the temperature measuring device can be clamped in the temperature measuring device recess, in the case of thermocouples, for example, by means of an annular tapered head screw. In this connection, a thread with a tapered runout is to be provided on the recess for the temperature measuring device. The thermocouple is guided with an external thread through the annular tapered head, which is preferably made of copper. This tapered socket or this tapered head screw then clamps the thermocouple when it is screwed in and at the same time presses it against the bottom of the bore by the direction of screwing.

It is advantageous for the module and its thermocouple recesses or bores to be produced by electric discharge machining. The aforementioned square-shaped or stepped square-shaped form of the module is especially well suited for this. The production method of "electric discharge machining" offers the advantage that drilling fins and drilling tapers are avoided, while at the same time the desired bore depth is maintained or realized with a high degree of precision. By the single machining of a component in electric discharge machining to produce a large number of bores, the costs for the electric discharge machining can be kept within reasonable limits.

To guarantee optimum heat transfer, the module is preferably made of the same material as the mold itself.

To improve the clarity of the cable layout, especially with respect to the connecting cables of the thermocouples on the module, it is advisable to use a central plug for the connecting cables of the thermocouples on the module. A central plug of this type can be designed as a pure multipolar plug connector or as a multiplexer. Alternatively, the central plug can also be designed as a bus interface or bus module, for example, a field bus module. The central plug would then be able to convert the signals of the thermocouples to a bus format. At the same time, the bus interface or the bus module should also be able to perform the conversion in the opposite direction, i.e., from the bus format to a format for an actuator signal. When a plurality of structural units are used, it can be useful to connect the central plugs on the individual structural units with a master central plug. With this circuit configuration, both the central plugs and the master central plug can be designed as bus interfaces.

The thermocouples can be connected to a suitable evaluation unit or automatic control system via the central plugs—if necessary, with the interconnection of the master central plug.

The specification is accompanied by six drawings.

DETAILED DESCRIPTION OF THE INVENTION

The invention is described in detail below with reference to the specific embodiments illustrated in the figures. In all of the figures, elements that are the same are designated with the same reference symbols.

Figure 1:
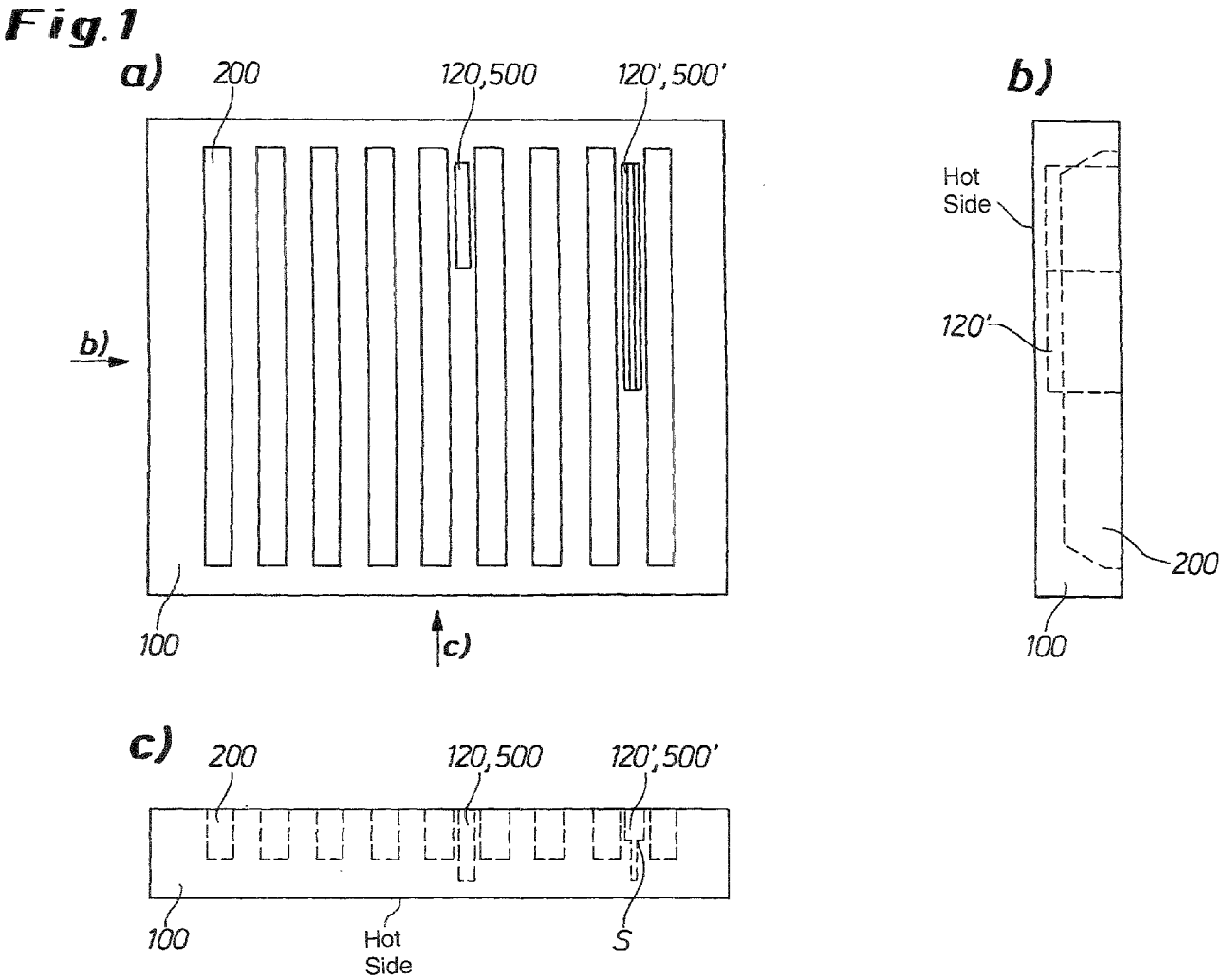
FIG. 1 shows the cold side of a mold with the recess and the structural unit in (a) a top view; (b) a first cross-sectional view; and (c) a second cross-sectional view.

FIG. 1(*a*) shows the cold side of a mold or, more precisely, a (side) wall 100 of the mold in a top view. The drawing shows vertically directed cooling channels 200 and recesses 120, 120' for the structural units 500 and 500' between the cooling channels. The recesses 120 and thus the structural units 500 and 500' possibly installed in the recesses are arranged in each case between two adjacent cooling channels. The modules 500 and 500' are drawn in different lengths in FIG. 1(*a*). This is intended to show that the structural units can be provided with different numbers of thermocouples in one and the same wall 100 of a mold.

FIG. 1(*b*) shows a cross section through the wall 100 of the mold according to FIG. 1(*a*) in the direction of casting. The recess 120' for the structural unit and the cooling channel 200 are shown in the drawing. The bottom of the recess 120 comes very close to the hot side H of the mold wall 100. This ensures that the thermocouples also actually determine the temperature distribution near the hot side H of the mold in a way that is as realistic as possible.

FIG. 1(*c*) shows a cross section through the wall 100 of the mold according to FIG. 1(*a*) transversely to the casting direction. This drawing clearly shows the different cross sections of the recesses 120 in the depth of the mold wall 100: strictly rectangular, not stepped, according to a first embodiment 120 or stepped according to a second embodiment 120'. In the stepped configuration S, the width of the recess 120' and the width of the structural unit 500' narrow in the region of greater depths. Due to this stepped configuration, greater rigidity of the structural unit is realized when it is installed in the recess.

Figure 2:
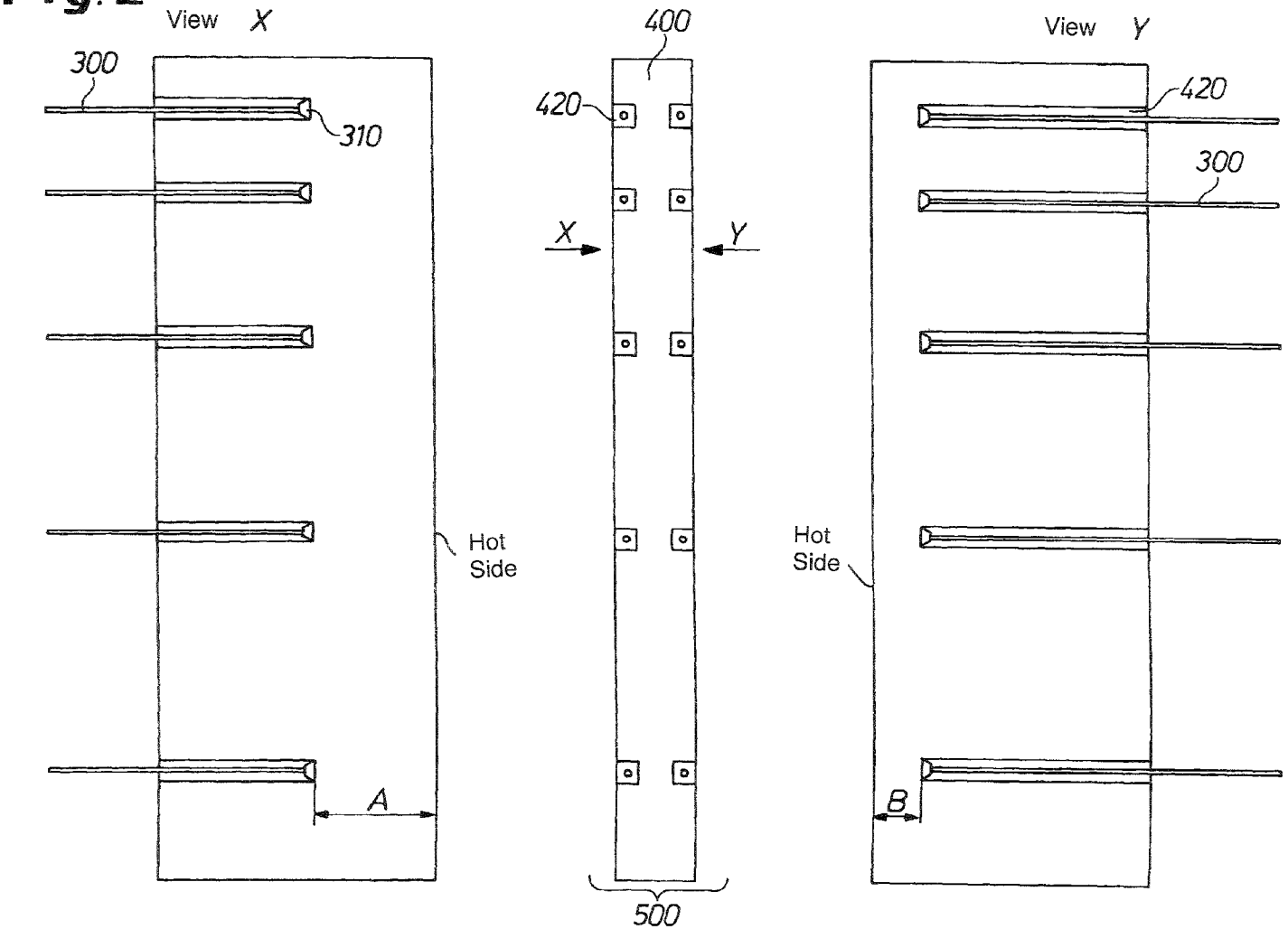
FIG. 2 shows a first embodiment of the structural unit in accordance with the invention from three different perspectives.

FIG. 2 illustrates the first embodiment of the structural unit 500. The drawings show that the temperature measuring device recesses 420 for the thermocouples 300 in the module 400 are formed by way of example as grooves in the sidewalls of the module. The formation of the grooves on the lateral edges offers the advantage that the thermocouples are accessible after they have been placed in the grooves; in particular, in this embodiment, the measuring tip 310 of the thermocouples 300 can be soldered with the bottom of the groove. FIG. 2 also shows that the thermocouples are arranged in opposing pairs. The thermocouples belonging to each such pair extend into the module to different depths; compare the distances A and B between the measuring tips 310 of the thermocouples and the edges H' of the hot side of the modules. These different distances A and B are needed for reliable computation of the heat flow density in the mold wall.

Figure 3:
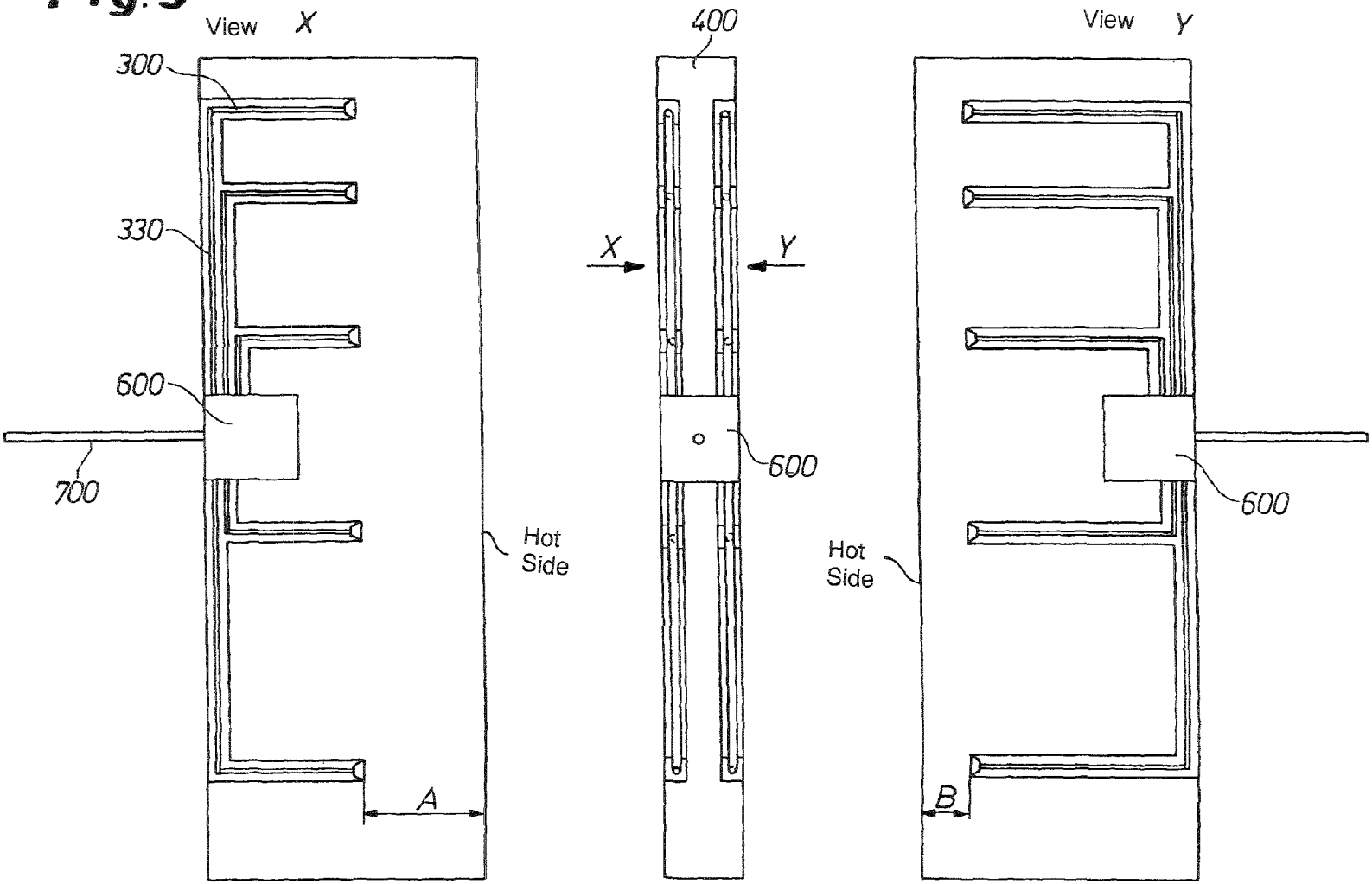
FIG. 3 shows the first embodiment of the structural unit of the invention in a variant with a central plug.

FIG. 3 shows the first embodiment of the module and structural unit according to FIG. 2 supplemented with a central plug 600 on the module 400. All of the connecting cables 330 of the thermocouples 300 on the module can be connected and bundled at the central plug 600. It allows the signals of all of the thermocouples to be passed on over preferably only a single, but possibly multiconductor, output cable 700. For this purpose, the central plug can be designed, for example, in the form of a multipolar plug connector. Alternatively, the plug can also be realized as a multiplexer. In another alternative, the central plug can also be designed as a bus interface and the cable 700 as a bus line. The bus interface, also called a bus module, is then designed to convert the signals of the thermocouples to the format or protocol of the given bus that is being used.

Figure 4:
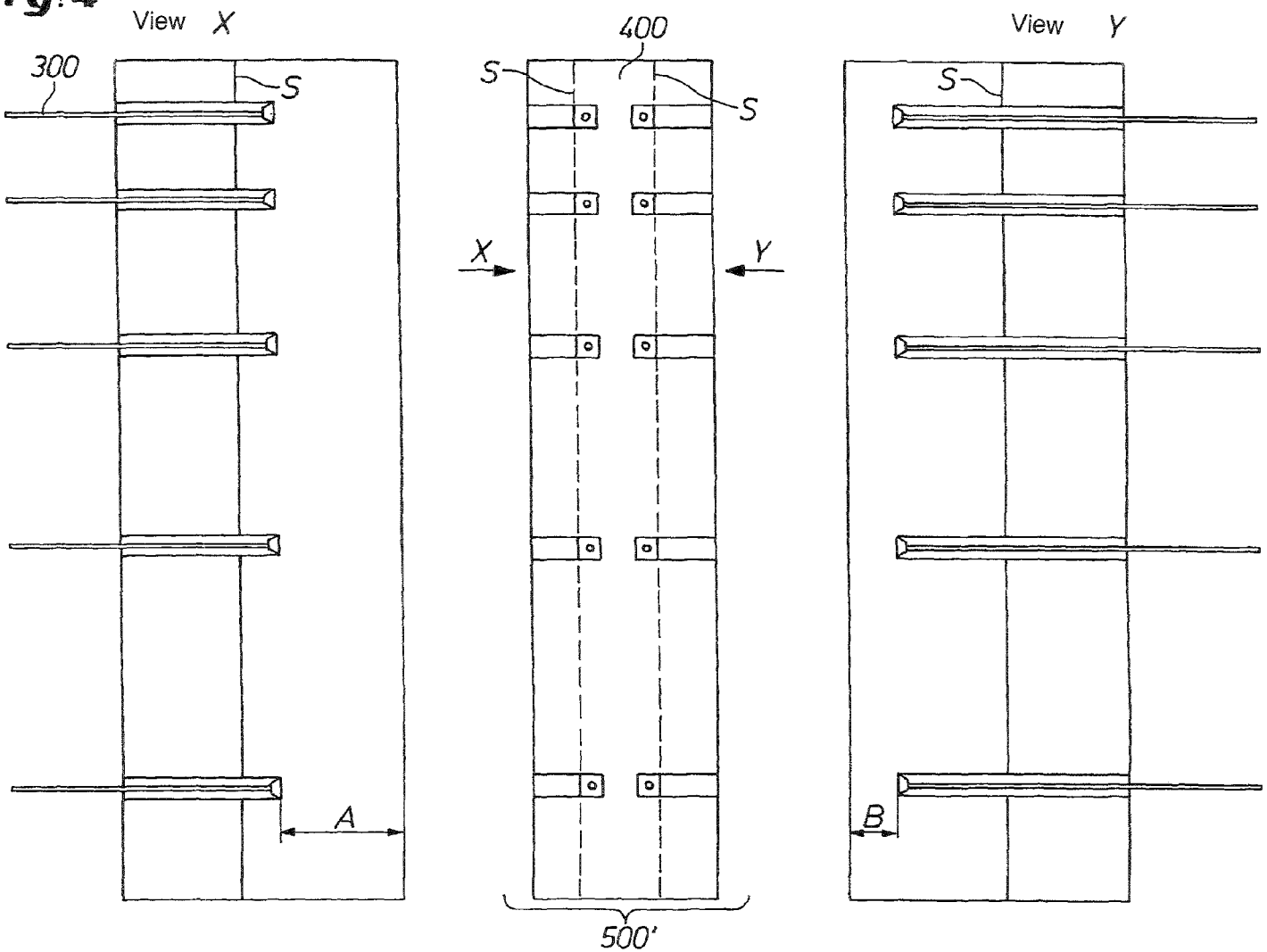
FIG. 4 shows a second embodiment (stepped) of the structural unit in accordance with the invention.

FIG. 4 shows a second embodiment of the module in accordance with the invention, here in the form of a stepped configuration. The step is indicated in FIG. 4 with the reference letter S in the form of vertical lines, some solid and some broken. The step in FIG. 1(*a*) is seen especially clearly.

Figure 5:
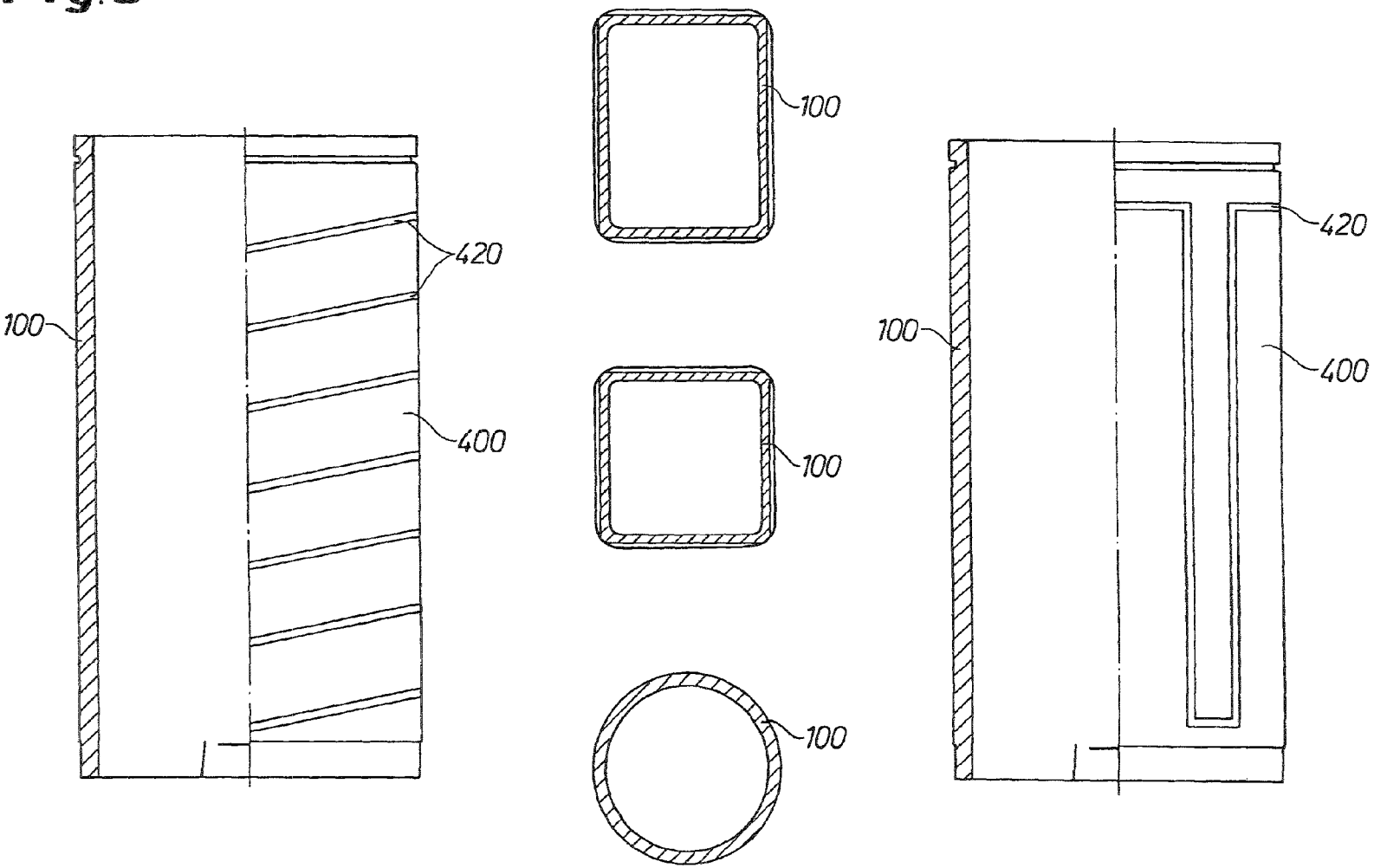
FIG. 5 shows a mold for rounds, rectangular sections, and square sections.

FIG. 5 shows a measuring setup of a mold for rounds, rectangular sections, and square sections.

Figure 6:
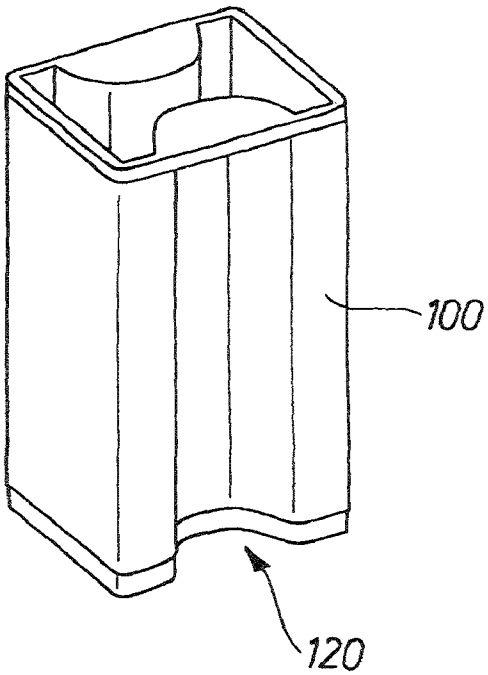
FIG. 6 shows a mold for beam blank.
Figure 6:
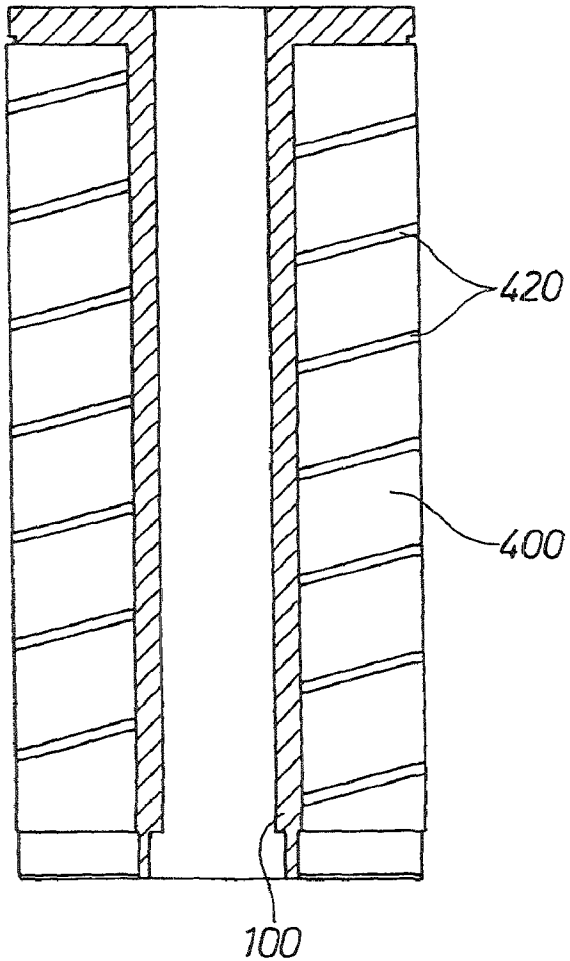

FIG. 6 shows a measuring setup of a mold for beam blank.

List of Reference Symbols

100 wall of the mold
120 recess for structural unit 500
120' recess for structural unit 500'
200 cooling channel
300 thermocouple
330 thermocouple connecting cable
400 module
420 recess for thermocouple
500 structural unit according to a first embodiment
500' structural unit according to a second embodiment
600 central plug
700 output cable
A, B distances
S step

The invention claimed is:

1. A mold for casting metal with a plurality of temperature measuring devices that are arranged in a wall of the mold for determining a temperature distribution in the wall during a casting operation;

wherein the temperature measuring devices are arranged in a module with fixed positioning relative to one another and, together with the module, form a structural unit;

wherein the module has temperature measuring device recesses in the form of a bore or groove for holding one temperature measuring device each; and wherein the structural unit is mounted in or on the wall of the mold to determine the temperature distribution;

wherein the temperature measuring devices are realized as fiber optic temperature sensors, which allow a temperature measurement by the optical time domain reflectometry method or the fiber Bragg grating method; in that the recesses for the temperature measuring devices are formed and arranged in the module in such a way that the fiber optic temperature sensors are arranged in adjacent pairs in the module; and in that the individual fiber optic temperature sensors of a pair are arranged at different depths in or on the module.

2. The mold in accordance with claim 1, wherein the wall of the mold has a recess for mounting the structural unit.

3. The mold in accordance with claim 2, wherein the recess for the structural unit is arranged on a cold side of the wall of the mold between its cooling channels.

4. The mold in accordance with claim 2, wherein the module and the recess are formed with a stepped construction in a direction from a cold side to a hot side of the mold.

5. The mold in accordance with claim 2, wherein the recess for the structural unit is formed as a lateral bore in the wall of the mold between its hot side and a bottom of the cooling channels.

6. The mold in accordance with claim 5, wherein the structural unit is formed as a horizontal bore.

7. The mold in accordance with claim 2, wherein after the structural unit has been mounted, the recess is sealed again by a plate-like covering.

8. The mold in accordance with claim 7, wherein the plate-like covering is flush with an outer surface of the wall of the mold.

9. The mold in accordance with claim 1, wherein the recess for a temperature measuring device is formed with a stepped construction with a varying diameter as seen over its depth.

10. The mold in accordance with claim 1, wherein the temperature measuring device is fixed in the recess by gluing or detachably clamping the temperature measuring device in, in such a way that a measuring tip or tips of the temperature measuring device are always in contact with a bottom or the wall of the recess for the temperature measuring device.

11. The mold in accordance with claim 1, wherein the module and the recess for the temperature measuring devices are produced at least partially by electric discharge machining.

12. The mold in accordance with claim 1, wherein the module and/or a cover for sealing the recess are made of the same material as the mold.

13. The mold in accordance with claim 12, wherein the module and/or a cover for sealing the recess are made of copper.

14. The mold in accordance with claim 1, wherein a central plug is provided in or on the module for receiving and bundling the connecting lines of all temperature measuring devices on the module.

15. The mold in accordance with claim 11, wherein the central plug is a multiplexer or a bus interface or bus module.

* * * * *